US009643821B2

(12) United States Patent
Burutjis et al.

(10) Patent No.: US 9,643,821 B2
(45) Date of Patent: May 9, 2017

(54) METHOD FOR POSITIONING COUNTER ENTRAINING MEANS OF A SHAFT DOOR OF A LIFT INSTALLATION

(71) Applicant: THYSSENKRUPP ELEVATOR AG, Essen (DE)

(72) Inventors: Petros Burutjis, Eningen unter Achalm (DE); Gerald Steinz, Stuttgart (DE); Maurizio Esposito, Boeblingen (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 185 days.

(21) Appl. No.: 14/394,242

(22) PCT Filed: Apr. 15, 2013

(86) PCT No.: PCT/EP2013/057812

§ 371 (c)(1),
(2) Date: Oct. 13, 2014

(87) PCT Pub. No.: WO2013/153228

PCT Pub. Date: Oct. 17, 2013

(65) Prior Publication Data

US 2015/0074971 A1 Mar. 19, 2015

(30) Foreign Application Priority Data

Apr. 13, 2012 (EP) ..... 12164174

(51) Int. Cl.
*B66B 19/00* (2006.01)
*B66B 13/12* (2006.01)
*B66B 13/20* (2006.01)

(52) U.S. Cl.
CPC ..... *B66B 19/00* (2013.01); *B66B 13/12* (2013.01); *B66B 13/20* (2013.01); *Y10T 29/49826* (2015.01)

(58) Field of Classification Search
CPC ..... B66B 19/00; B66B 19/04; B66B 13/12; B66B 13/20; B66B 13/16;
(Continued)

(56) References Cited

U.S. PATENT DOCUMENTS 5,544,720 A * 8/1996 Spiess ..... B66B 13/12 187/319
5,636,715 A 6/1997 Hayashi et al.

FOREIGN PATENT DOCUMENTS

EP 0744373 B1 11/1996
EP 1500625 A1 1/2005
(Continued)

OTHER PUBLICATIONS

German Language International Search Report for International patent application No. PCT/EP2013/057812; mailing date Jul. 11, 2013.
(Continued)

*Primary Examiner* — Christopher Besler
(74) *Attorney, Agent, or Firm* — Thyssenkrupp North America, Inc.

(57) ABSTRACT

A method for positioning counter entraining means which are provided on a shaft door of a lift installation, with respect to entraining means provided on a lift cage door of a lift cage of the lift installation, wherein the shaft door and the lift cage door can be coupled to each other by the entraining means acting upon the counter entraining means. The method comprises moving the lift cage into a floor position, opening the lift cage door, fixing the shaft door in the closed state, providing the counter entraining means, which are provided on the shaft door, with clearance with respect to the shaft doors, closing the lift cage door, actuating the entraining means, which are formed on the lift cage door, to act upon the counter entraining means, wherein the counter entraining means are displaced into an optimized position with respect to the entraining means on the shaft door, ending the action
(Continued)

of the entraining means on the counter entraining means, re-opening the lift cage door while keeping the shaft door closed, and securing the counter entraining means to the shaft door in the optimized position set by the action of the entraining means.

7 Claims, 3 Drawing Sheets

(58) Field of Classification Search
CPC ..... Y10T 29/49895; Y10T 29/49826; Y10T 29/49899; Y10T 29/49902
USPC ..... 187/316, 315
See application file for complete search history.

(56) References Cited

FOREIGN PATENT DOCUMENTS

| | | | |
|---|---|---|---|
| JP | 52086166 | U | 6/1977 |
| WO | 2011072891 | A1 | 6/2011 |

OTHER PUBLICATIONS

English Translation of International Search Report for International patent application No. PCT/EP2013/057812; mailing date Jul. 11, 2013.
English translation of abstract of EP1500625 (A1).
English translation of abstract of EP0744373 (B1).

* cited by examiner

METHOD FOR POSITIONING COUNTER ENTRAINING MEANS OF A SHAFT DOOR OF A LIFT INSTALLATION

CROSS REFERENCE TO RELATED APPLICATIONS

This application is a U.S. National Stage Entry of International Patent Application Serial Number PCT/EP2013/057812, filed Apr. 15, 2013, which claims priority to European patent application no. 12164174.0, filed Apr. 13, 2012.

FIELD

The present invention relates to a method for positioning counter entraining means which are provided on a shaft door of an elevator installation.

BACKGROUND

Elevator doors usually have an elevator car door which is provided on the elevator car, and shaft doors provided on each story. When the elevator car moves up to each story, both the elevator car door and the corresponding shaft door (then positioned behind the elevator car door) are opened and closed to allow passengers to get on or off or to continue the movement of the elevator car.

An elevator car door usually has a drive by means of which said elevator car door can be opened and shut. In order to avoid corresponding drives for each shaft door, the elevator car door is designed with entraining means or a dog-type mechanism which engages with corresponding counter entraining means of the shaft door upon reaching a story and opens and shuts said shaft door at the same time. Expanding skate mechanisms, as are described, for example, in EP 0 744 373 B1, are customarily used in this case.

In particular in what is referred to as a high-performance elevator car door, it is essential to avoid rattling and wind noises at very high traveling speeds. Furthermore, elevator doors of this type are intended to open and shut as rapidly as possible. Precise positioning of the entraining means and the counter entraining means with respect to one another is essential in order to avoid such noises and to permit rapid opening and closing of the door.

A further device for entraining a shaft door by an elevator car door, which is actuatable by a door drive, for elevator installations is known from WO 2011/072891.

It is conventionally customary to position entraining means, which are designed as an expanding skate which is attached to the elevator car door, and counter entraining means, which are designed as rollers and are provided on each shaft door, in the vicinity of the door upper edges.

This makes it possible for a fitter to set a desired positioning of the counter entraining means with respect to the entraining means from the elevator car roof. This generally takes place by the elevator car being moved into a position somewhat below a story position such that the expanding skate provided on the elevator car and the rollers which are provided on the shaft door and in which the expanding skate engages for carrying along the shaft door are visible simultaneously for the fitter. This procedure has proven favorable in particular because the upper end of the expanding skate projects over the upper edge of the elevator car.

The fitter sees the position of the expanding skate in a folded-up state, and at the same time identifies the lifting movement of the expanding skate angle member of the expanding skate, from the folded state into the moved-apart coupling or end state. On the basis of this optical information, the fitter is capable of positioning the rollers, which serve as the counter entraining means and between which the expanding skate is intended to engage, in such a manner that, in the unfolded state, the expanding skate angle members each act upon a roller and therefore couple elevator car door and shaft door. Customarily, the two rollers, optionally with further components of a coupling and locking mechanism, are provided here on a carrier plate which is formed with elongated holes. The elongated holes here are positioned in front of corresponding threads formed in the shaft door, and therefore a desired displacement and fixing of the carrier plate with respect to the shaft door is possible using screws which interact with the elongated holes and the threads.

However, in this procedure, a positioning of the counter entraining means, in particular of a carrier plate with two rollers, and of the expanding skate is possible merely in the immediate vicinity of the upper edge of the shaft door or elevator car door. This means that the coupling of elevator car door and shaft door also takes place in the surroundings of the upper edge of the doors, and this, in particular in the case of doors which are to open and close rapidly, results in a relatively severe and nonuniform torque loading of the doors.

Furthermore, the outlay to be expanded on safety is relatively high since the work has to be carried out from the elevator car roof.

Finally, such an installation is considered to be relatively complicated since the positioning of the rollers substantially takes place by sight. In practice, this generally leads to the position of the rollers and of the carrier plate having to be readjusted, which is associated with repeated moving of the elevator car.

EP 1 500 625 A1 describes a method in which the positioning of the rollers on the shaft door is carried out by means of action by expanding skate angle members.

SUMMARY

The present invention seeks a simplified and at the same time precise positioning of the counter entraining means with respect to the entraining means of a coupling mechanism for elevator car door and shaft doors of an elevator installation.

This object is achieved by a method as disclosed herein.

DETAILED DESCRIPTION

Figure 1B:
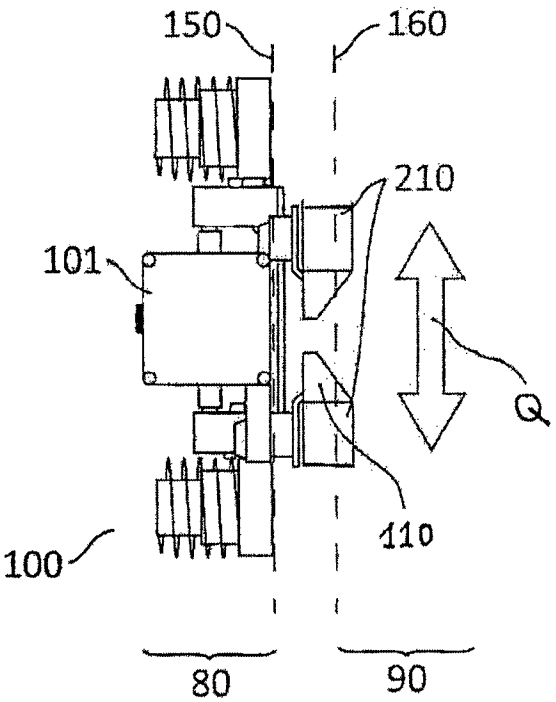
FIGS. 1*a* and 1*b* are top plan schematic views of an embodiment of an entraining means depicted in different operating positions, together with an embodiment of a counter entraining means disposed on a shaft-door side, in which an embodiment of a method of the present disclosure may be practiced.

A method which can be carried out rapidly and effectively and at the same time precisely for positioning entraining means and counter entraining means with respect to one another is made available by the method according to the invention. The method permits a substantially arbitrary positioning of the entraining means and counter entraining means on the elevator car door and shaft door. By means of the automated and very precise positioning, rattling noises during the journey of the elevator car and also during the opening and closing of the doors are minimized or avoided. It should be noted that the steps of the method according to the invention do not necessarily have to be carried out in the stated sequence. For example, it is conceivable to interchange the sequence of the steps of the movement of the elevator car into a story position and of the opening of the elevator car door with each other, i.e., for example, to move the elevator car with the elevator car door already open into the story position. Also, for example, the fixing of the shaft door in the closed state can already be carried out before movement of the elevator car into the story position or before the opening of the elevator car door. The providing of the counter entraining means with a clearance can also already take place, for example, before the moving of the elevator car into the story position or before the opening of the elevator car door or before the fixing of the shaft door in the closed state.

The term "story position" is understood as meaning, in particular, the position of the elevator car, in which entry and exit of a person is readily possible. In particular, this term comprises the normal stop position, in which the floor of the elevator car and the floor of the respective story are oriented flush with each other. However, elevator car positions slightly below or slightly above the normal stop position, for example ±20-40 cm, are also covered by the term. The term is intended in particular to comprise all elevator car positions in which the entraining means and the counter entraining means are operatively connected to one another, in other words the elevator car is in the coupling zone or unlocking zone.

Under normal operating conditions, when the elevator car moves into the story position, the entraining means and the counter entraining means are brought into operative connection with one another. For example, the entraining means can be introduced into the counter entraining means.

Opening of the elevator car door while simultaneously keeping the shaft door closed is possible, for example, by manual decoupling of the elevator car door from the shaft door. For this purpose, for example, a control function which, when the elevator car is positioned in the story position, disengages the entraining means from the counter entraining means, can be provided. It is likewise possible first of all to open the shaft door together with the elevator car door, and then subsequently only to close the shaft door again.

Opening of the elevator car door can take place, for example, manually or else by actuation of the corresponding drive of the elevator car door.

Fixing of the shaft door in the closed state can be brought about, for example, manually, by use of corresponding blocking tools.

The counter entraining means provided on the shaft door can already be formed with a clearance with respect to the shaft door when the elevator car arrives in the story position. However, it is likewise possible for the counter entraining means to be fastened without a clearance to the elevator car door when the elevator car arrives, and for a fitter (for example located in the interior of the elevator car) to provide the counter entraining means with a clearance. The method according to the invention can therefore be used for the initial setting and also for a readjustment of the position of the counter entraining means.

The reclosing of the elevator car door can take place, in turn, manually, or by use of the elevator car door drive. The actuation of the entraining means, which are formed on the elevator car door, for acting upon the counter entraining means substantially corresponds to the normal coupling operation of elevator car door and shaft door, in which the entraining means engage in the counter entraining means in order to bring about a fixed coupling between the two doors such that the two doors can be opened and closed by the elevator car door drive. However, in this case, the counter entraining means, because of the clearance thereof, are displaced or brought into a desired position on the shaft door.

Ending of the action upon the counter entraining means by the entraining means is, in turn, understood as meaning a disengagement of the entraining means from the counter entraining means, as a result of which, in turn, an opening of the elevator car door while keeping the shaft door closed is possible.

The subsequent fastening of the counter entraining means to the shaft door can then take place by a fitter (for example located in the interior of the elevator car).

The fixing of the shaft door in the closed state can then be released.

Advantageous refinements of the invention are the subject matter of the dependent claims.

Expediently, the counter entraining means have two spaced-apart rollers, and the entraining means have an expanding skate which can be introduced between the rollers and has two expanding skate angle members, wherein, by means of movement apart of the expanding skate angle members introduced between the rollers, said rollers are displaced into the desired position thereof on the shaft door and are fastened in said position. Such entraining means and counter entraining means have proven to be able to be set particularly easily, and to be robust and reliable with regard to maintenance and wear.

The rollers are expediently at a fixed spacing from one another on a carrier plate, wherein the carrier plate has at least one elongated hole. By means of such a mechanism, displacement of a carrier plate, with the rollers attached thereto, with respect to a shaft door is possible in a simple manner by action by means of an expanding skate. It should be noted that the rollers can also be directly displaceable on and fixable to a shaft door (i.e. in particular without a carrier plate). For this purpose, it is possible, for example, to form elongated holes in the shaft door, in which or with regard to which the rollers can be positioned. It is likewise conceivable to design the rollers to be displaceable with respect to a carrier plate as far as a stop. In this case, action by means of the expanding skate would first of all cause a movement of the rollers with respect to the carrier plate, and only after the respective stops are reached, would cause a displacement of the carrier plate with respect to the shaft door. This refinement permits provision of the already depicted coupling and entraining function with an unlocking function using just two rollers. The unlocking function is used in order to unlock a locking mechanism, by means of which an opening of the shaft door is not possible during normal operation of the elevator if the elevator car or the elevator car door is not located directly behind the shaft door. In this case, it is expedient, during the positioning process, to temporarily fix the rollers in the position thereof after reaching the stops. This makes it possible to avoid said rollers moving during the removal of the expanding skate within the course of the positioning process and hence possibly causing a displacement of the carrier plate.

According to a particularly preferred embodiment of the method according to the invention, at least one of the method steps is at least partially brought about by a fitter (operator) located in the interior of the elevator car. By this means, the safety of the operator is substantially improved in relation to conventional positioning processes which have had to be carried out from the elevator car roof. The method according to the invention can also be carried out more rapidly and at the same time more precisely than conventional methods. It is preferred in this case for all of the method steps as listed in the main claim to be able to be carried out by an operator located in the interior of the elevator car.

It has proven expedient to form the counter entraining means and/or the entraining means at half the height of the shaft door and elevator car door. Owing to the more uniform loading both of the counter entraining means by the entraining means and of the respective doors in comparison with conventional solutions, wear is also reduced in comparison to known solutions, and therefore the outlay on maintenance can be reduced.

The method according to the invention permits for the first time the formation or arrangement of the entraining means and/or of the counter entraining means at half the height of the elevator car door and of the shaft door. By this means, torques which occur during the opening and closing of the doors and which act on the doors can be significantly reduced. "Approximately at half the height" is understood as meaning, in particular, a distance of 50-150 cm, in particular 100-150 cm, from a lower edge and/or upper edge of an elevator car door or shaft door, or else a positioning within a range of up to 50 cm above or below the half door height. For entraining means designed as expanding skate angle members, this means, in particular, that the central region of the vertically extending expanding skate angle members are positioned approximately at half the height of the elevator car door. Such a positioning of the entraining means and/or counter entraining means also results in particularly easy accessibility for a fitter located in the interior of the elevator car.

Figure 1A:
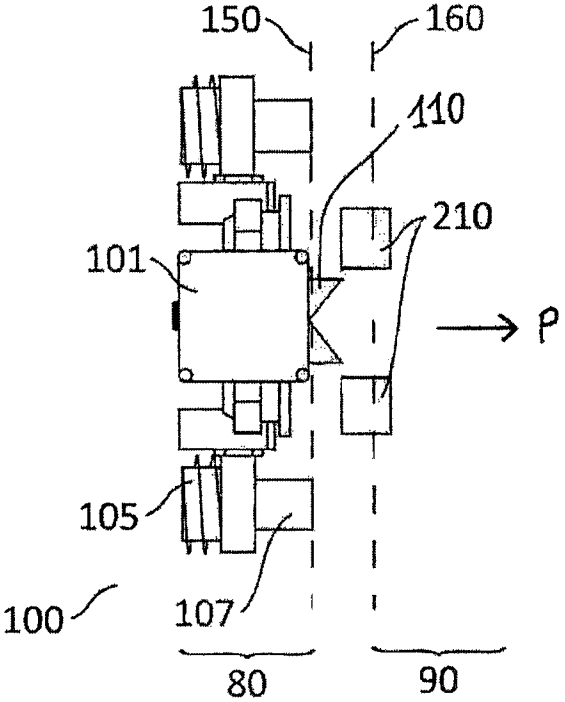

Preferred embodiments of the invention will now be explained in more detail with reference to the attached drawing, in which:

In FIGS. 1*a*, 1*b*, a preferred embodiment of an entraining device, in which the method according to the present invention can be carried out, is illustrated and denoted overall by 100.

The device 100 serves for coupling an elevator car door to a shaft door of an elevator. Elevator car door and shaft door are merely indicated schematically by means of brackets in 1*a*, 1*b* and denoted by 80 and 90, respectively. By means of the coupling, which is provided by the device 100, between elevator car door 80 and shaft door 90, only the elevator car door 80 has to be designed with a door drive (not illustrated) which opens or closes the elevator car door 80. Owing to the coupling, a dedicated drive does not have to be provided for the shaft door 90.

On the elevator-car-door side, the device 100 has two expanding skate angle members 110 which interact with rollers 210, which are attached on the shaft-door side, for coupling elevator car door and shaft door, as is described further below. The expanding skate angle members 110 therefore constitute entraining means, and the rollers 210 counter entraining means, within the context of the invention.

On the elevator-car-door side, the device 100 has an expanding skate angle member drive 101 which serves to couple the expanding skate angle members 110 to the rollers 210. For this purpose, the expanding skate angle members 110 are first of all extended between the rollers 210 in the direction of the shaft door by means of the drive 101 (indicated by means of arrow P in FIG. 1*a*) and expanded in this position (indicated by means of arrow Q in FIG. 1*b*). This extended and expanded position is illustrated in FIG. 1*b*.

The described extension and expansion of the expanding skate angle members 110 results in the expanding skate angle members acting upon the respective rollers 210 and therefore coupling elevator car door and shaft door to each other. In this state, elevator car door and shaft door are coupled to each other, via the coupling of expanding skate angle members 110 and rollers 210, in such a manner that an opening and closing of the elevator car door 80 by means of an elevator car door drive (not illustrated) leads to an entraining of and simultaneous opening or closing of the shaft door 90.

In order to release the coupling between elevator car door and shaft door again, the described operation has to be reversed, i.e. the expanding skate angle members 110 are folded again by means of the drive 101 and retracted into the positions illustrated in FIG. 1*a*.

A precise positioning of the rollers 210 with respect to the expanding skate angle members 110 is of great importance. If, namely, for example, the expanding skate angle members 110, in the state illustrated in FIG. 1*a*, are arranged non-symmetrically or in the center of the rollers 210, an asymmetric or non-simultaneous action upon the rollers 210 can occur during the expansion of the expanding skate angle members, which may be perceptible, for example, in an increased noise annoyance (rattling noises) or else in increased wear.

During the installation of an elevator installation, the rollers 210 on the shaft door therefore have to be positioned as precisely as possible with respect to the expanding skate angle members 110 and the elevator car door. This is where the present invention starts.

Figure 2:
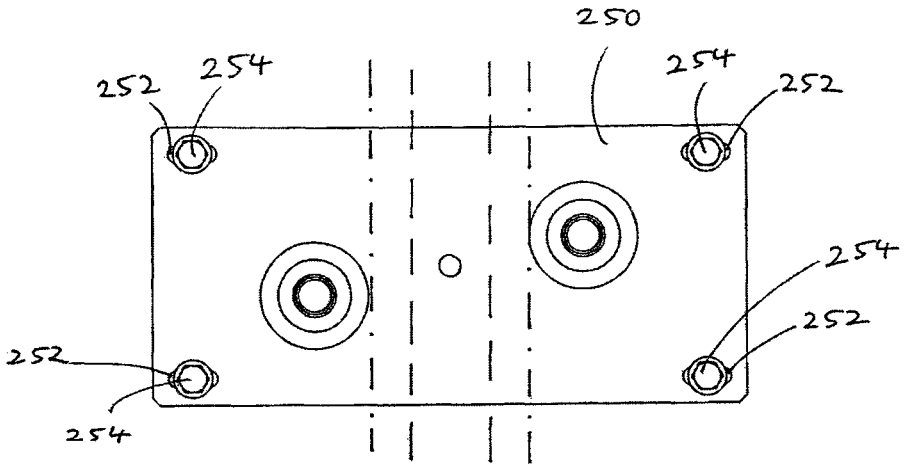
FIG. 2 is a front plan view of an embodiment of a counter entraining means of the present disclosure.
Figure 3:
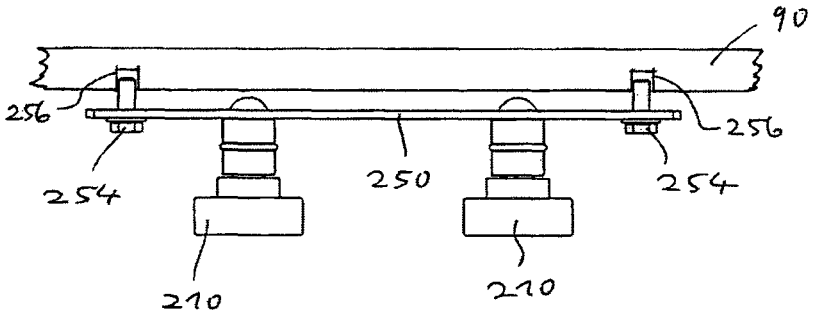
FIG. 3 is a top plan view of the embodiment of the counter entraining means of FIG. 2, as disclosed herein.

FIGS. 2 and 3 illustrate a preferred structural possibility for realizing the invention. It is seen here that the rollers 210 are attached here to an assembly plate 250. Said assembly plate 250 is formed with a number of elongated holes 252 (four such elongated holes 252 are provided in the example illustrated). Screws 254 which interact with corresponding threads 256, which are formed in the shaft door 90, can be passed through said elongated holes 252.

In the event of a loose, i.e. not tightened, introduction of the screws 254 into the thread 256, the displacability of the assembly plate 250, and therefore of the rollers 210, with respect to the shaft door 90 is provided. The rollers here therefore have a clearance with respect to the shaft door.

Figure 4:
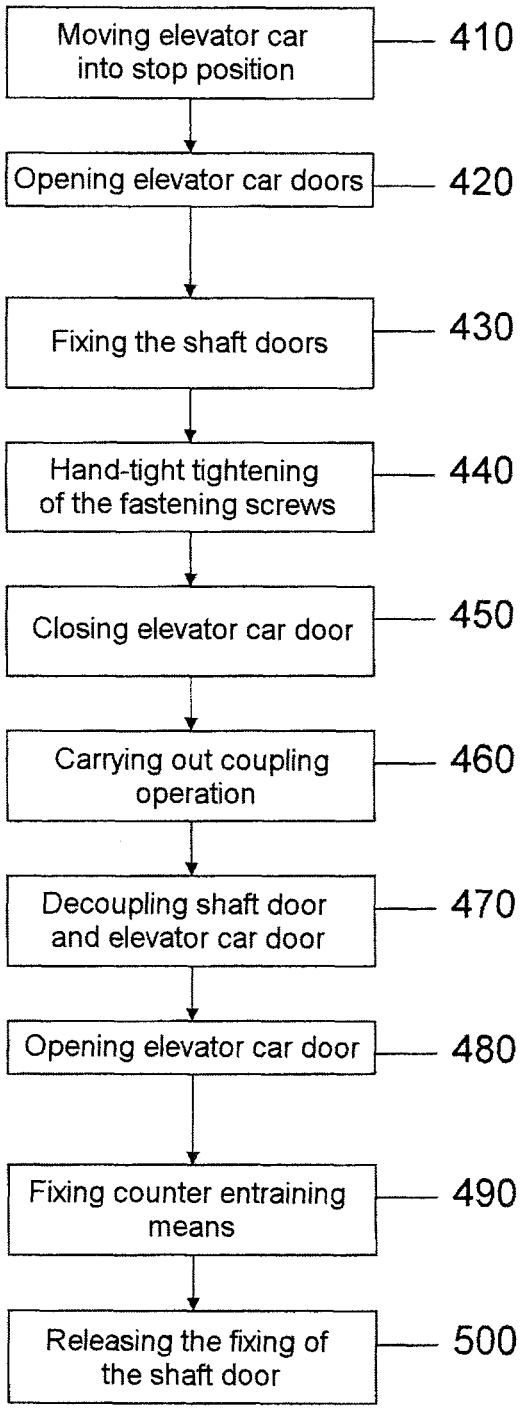
FIG. 4 is a flow chart depicting an embodiment of a method disclosed herein.

Reference is also made to FIG. 4 below in order to illustrate the method according to the invention.

In order to position the rollers 210 with respect to the expanding skate angle members 110, the elevator car is first of all moved into a respective stop point (story position) (step 410). Subsequently, the elevator car doors are opened by the fitter (expediently from the interior of the elevator car) (step 420), wherein said elevator car doors should not be coupled here to the shaft doors.

The shaft doors 90 are subsequently fixed against sliding open or against moving during the positioning operation which then follows (step 430).

It is also possible first of all to open the elevator car door and the shaft door coupled thereto, to release the coupling and subsequently to close the shaft door again and to fix the latter in the closed position.

In order to be able to set the rollers 210, which serve as counter entraining means, in the position thereof relative to the shaft door 90 or relative to the expanding skate angle members serving as entraining means, in order to provide a clearance for the rollers, first of all the fastening screws 254 are loosened and are expediently tightened again hand-tight (step 440). By this means, the assembly plate 250 can be displaced with a slight effort relative to the shaft door 90. At the same time, it is ensured that, after the end of the automatic positioning, the position of the assembly plate 250 can be maintained in order subsequently to bring about the final fastening or setting of the position by firm tightening of the screws 254.

In this state of the released fastening screws 254 which are tightened hand-tight, the elevator car door 80 is first of all closed again by means of the elevator car door drive (step 450). The (fixed) shaft door remains closed here. The elevator car door 80 is held in said closed position exclusively by means of the elevator car door drive (operating position). It is important for precise positioning that said operating position is maintained during the positioning process.

The automatic positioning of the assembly plate 250 with the rollers 210 provided thereon is then started. For this purpose, only the coupling operation already described with reference to FIGS. 1*a*, 1*b* (extension and expansion of the expanding skate angle members) has to be started (step 460), i.e. an actuation of the entraining means, which are formed on the elevator car door, for action upon the counter entraining means has to be carried out.

The positions of the expanding skate angle members are illustrated schematically in FIG. 2 for illustrative purposes. The dashed lines show the extended and non-expanded position of the expanding skate angle members, while the chain-dotted lines illustrate the extended and expanded positions of the expanding skate angle members. In this position illustrated by means of chain-dotted lines, the expanding skate angle members 110 act upon the rollers 210, wherein, in this state with non-tightened fastening screws 254, corresponding displacement of the rollers 210 is brought about by means of the action by the expanding skate angle members 110 if the rollers 210 are not positioned exactly symmetrically with respect to the expanding skate angle members.

After the end of said coupling operation and possible displacement of the assembly plate 250 by means of action upon the rollers 210 by the expanding skate angle member 110, the rollers 210 are positioned in the optimum or optimized position thereof with respect to the expanding skate angle members 110.

The shaft door 80 and the elevator car door 90 are subsequently decoupled again (step 470) (i.e. the action upon the counter entraining means by the entraining means is ended) and the decoupled elevator car door is opened once again (for example manually) (step 480). As mentioned, the assembly plate 250 is then in the optimum or desired position in order to ensure a symmetrical and simultaneous action upon the rollers 210 by the expanding skate angle members 110 during further coupling operations. This position can then be fixed by simple tightening of the screws 254 (step 490). The fixing of the shaft doors is subsequently released again (step 500). The positioning or setting operation is thereby ended and can be repeated for each further story.

Compared to conventional positioning processes, the solution according to the invention provides a significant saving on time since the counter entraining means are already movable into the desired position on the shaft door during the first action thereupon or interaction therewith by the entraining means.

Entraining means and counter entraining means are optimally positionable with respect to one another solely because of the mutual interaction with one another. The method according to the invention is also distinguished by increased safety since the entire positioning operation can be carried out by a fitter located within the elevator car.

With the solution according to the invention, it is possible in particular to arrange the counter entraining means, i.e. the rollers 210, on the shaft door approximately at half the height of the shaft door and elevator car door. By means of such a coupling at half the height of the doors to be coupled, a more rapid subsequent opening or closing of the coupled doors is possible. By this means, a more uniform loading of the doors during the opening or closing is also ensured. In the event of a conventional coupling in the vicinity of the upper edge of the doors, relatively large torques act overall, in particular in the region of the lower edge, on the individual doors.

The invention claimed is:

1. A method for positioning a counter entraining means provided on a shaft door of an elevator installation with respect to entraining means provided on an elevator car door of an elevator car of the elevator installation, wherein the shaft door and the elevator car door are configured to be coupled to each other by action of the entraining means upon the counter entraining means, the method comprising:

moving the elevator car to a story position;

opening the elevator car door;

fixing the shaft door in a closed state;

providing the counter entraining means on the shaft door with a clearance with respect to the shaft door;

closing the elevator car door;

actuating the entraining means formed on the elevator car door to act upon the counter entraining means, wherein the counter entraining means are displaced by said action thereupon into a position on the shaft door that is optimized with respect to the entraining means;

ending the action upon the counter entraining means by the entraining means;

re-opening the elevator car door while keeping the shaft door closed; and fastening the counter entraining means to the shaft door in the optimized position set by the action of the entraining means.

2. The method of claim 1, wherein the counter entraining means have two spaced-apart rollers, and the entraining means have two expanding skate angle members coupled to an expanding skate that is configured to be introduced between the rollers.

3. The method of claim 2, wherein said actuating step further includes introducing the expanding skate angle members between the rollers of the counter entraining means, and moving the expanding skate angle members away from each other so as to cause the rollers to be displaced to a position on the shaft door that is optimized with respect to the expanding skate angle members.

4. The method of claim 3, wherein the rollers are disposed at a fixed spacing from one another on a carrier plate or assembly plate, and wherein the carrier plate has at least one elongated hole.

5. The method of claim 1, wherein at least one of said method steps is at least partially initiated by an operator located in an interior of the elevator car.

6. The method of claim 1, wherein the counter entraining means are disposed at about half the height of the shaft door.

7. The method of claim 1, wherein the entraining means are formed at approximately half the height of the elevator car door.

* * * * *